United States Patent [19]

Bird

[11] 4,177,577

[45] Dec. 11, 1979

[54] SHELF ARRANGEMENT FOR FREEZE DRYING APPARATUS

[75] Inventor: Harry L. Bird, Red Hook, N.Y.

[73] Assignee: The Virtis Company, Inc., Gardiner, N.Y.

[21] Appl. No.: 906,678

[22] Filed: May 16, 1978

[51] Int. Cl.[2] ..... F26B 13/30

[52] U.S. Cl. ..... 34/92

[58] Field of Search ..... 34/92, 5

[56] References Cited

U.S. PATENT DOCUMENTS

| | | | |
|---|---|---|---|
| 3,199,217 | 8/1965 | Oldenkamp et al. | 34/92 |
| 3,271,874 | 9/1966 | Oppenheimer | 34/92 |
| 3,286,366 | 11/1966 | Seligman | 34/92 |
| 3,384,978 | 5/1968 | Cox | 34/92 |
| 3,775,942 | 12/1973 | Powell et al. | 34/92 UX |
| 3,795,986 | 3/1974 | Sutherland et al. | 34/92 |
| 3,950,963 | 4/1976 | Sutherland | 34/92 |

*Primary Examiner*—John J. Camby

*Attorney, Agent, or Firm*—Kirkland & Ellis

[57] ABSTRACT

A shelf arrangement is disposed within the vacuum drying chamber of a freeze dryer. The shelf arrangement has multiple vertically-movable shelves that are suspended by stops on flexible wires stretched between upper and lower brackets of a frame assembly. Each shelf has four flanges extending from the edge thereof which comprise arms that straddle corresponding wires thereby engaging the stops so that the shelves are positioned in a vertical arrangement. The slots between the arms of the flanges allow the shelves to slide vertically along the wires when multiple screw members which engage following threaded nuts attached to the lower most shelf of the group of shelves are rotated. Thus, as the lower most shelf is raised, it engages the next highest shelf and so forth until all of the shelves are elevated vertically against the upper bracket. The power to elevate the shelves is supplied by a drive system mounted externally of the vacuum chamber of the freeze dryer which has a shaft that extends into the freeze drying chamber. The drive assembly includes a plate mounted for rotation about the output shaft that extends into the drying chamber. A motor and gear reduction are mounted on the plate and adjustable limits are mounted adjacent to the plate to limit the rotation of the plate and to sense the amount of torque being delivered through the output shaft. A microswitch can be mounted to turn off the motor when a predetermined torque is sensed. The plate may be connected to a hydraulic damper which dampens out excessive transient forces produced by the motor thereby preventing premature motor stoppage.

A latching mechanism is also provided to latch certain shelves in an elevated position against the upper bracket so that the remaining shelves can be repositioned in the remaining space by spacers attached to the wires.

7 Claims, 21 Drawing Figures

FIG. 10
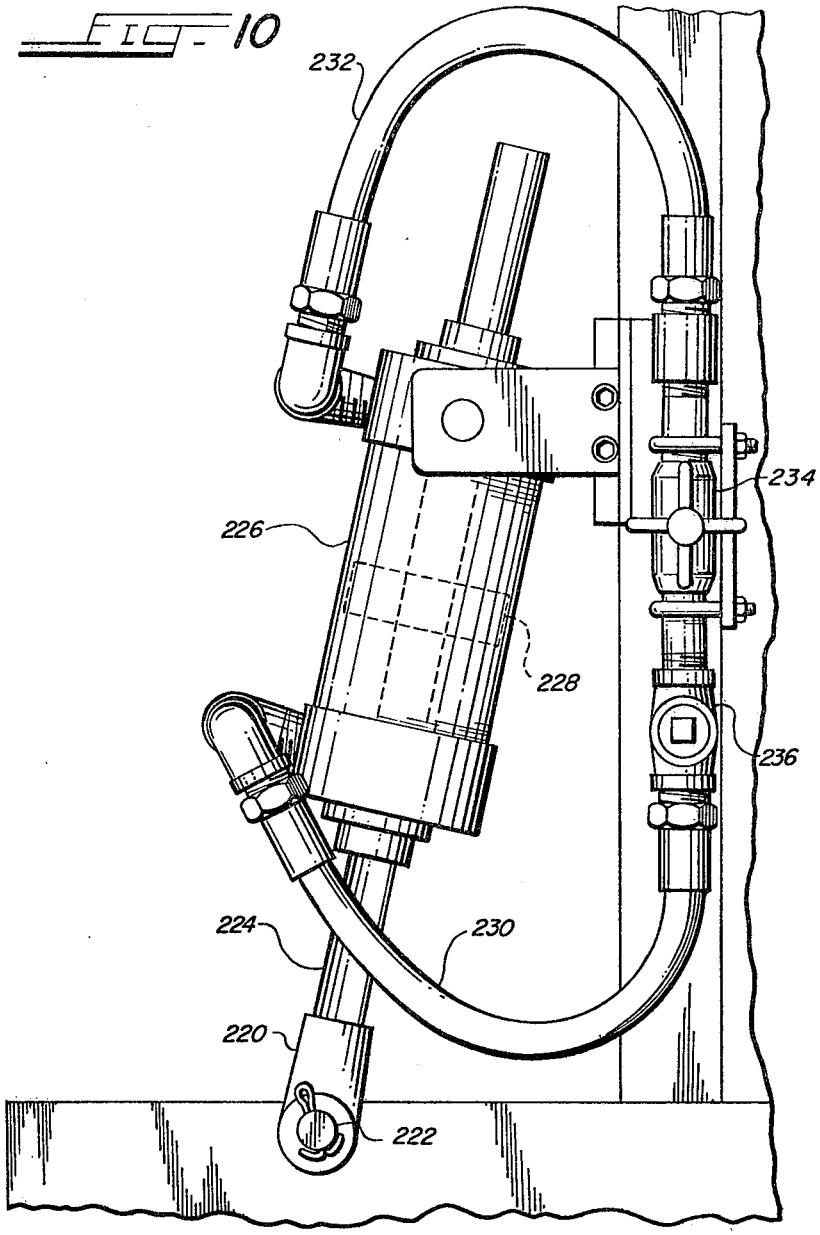
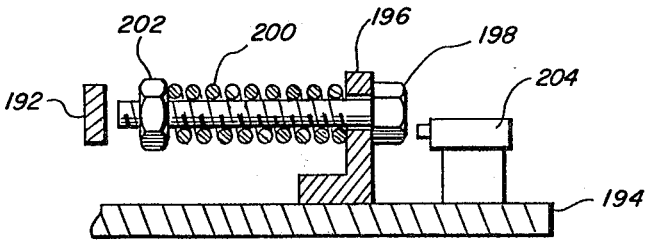
FIG. 7B

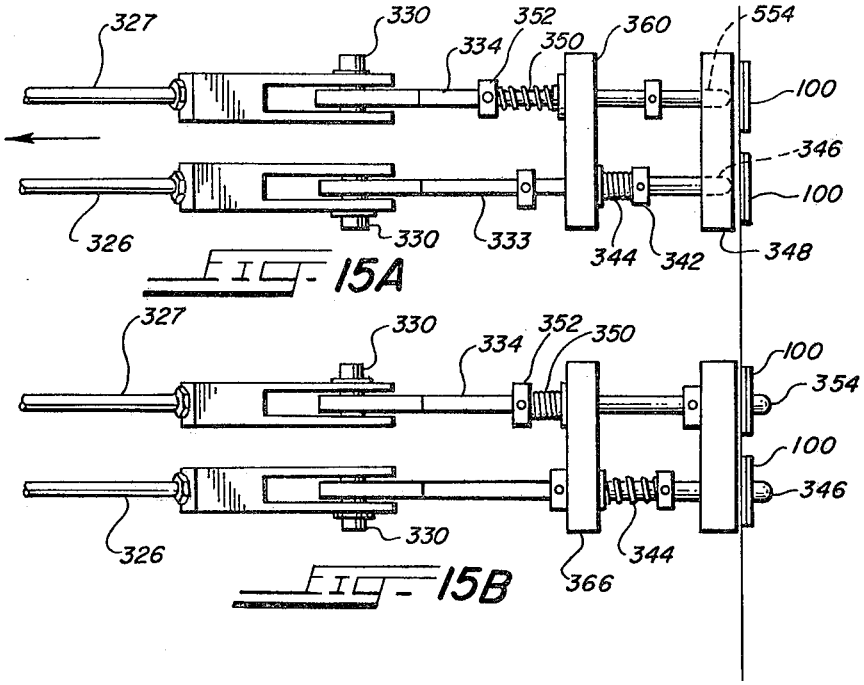
FIG. 15A
FIG. 15B
FIG. 14
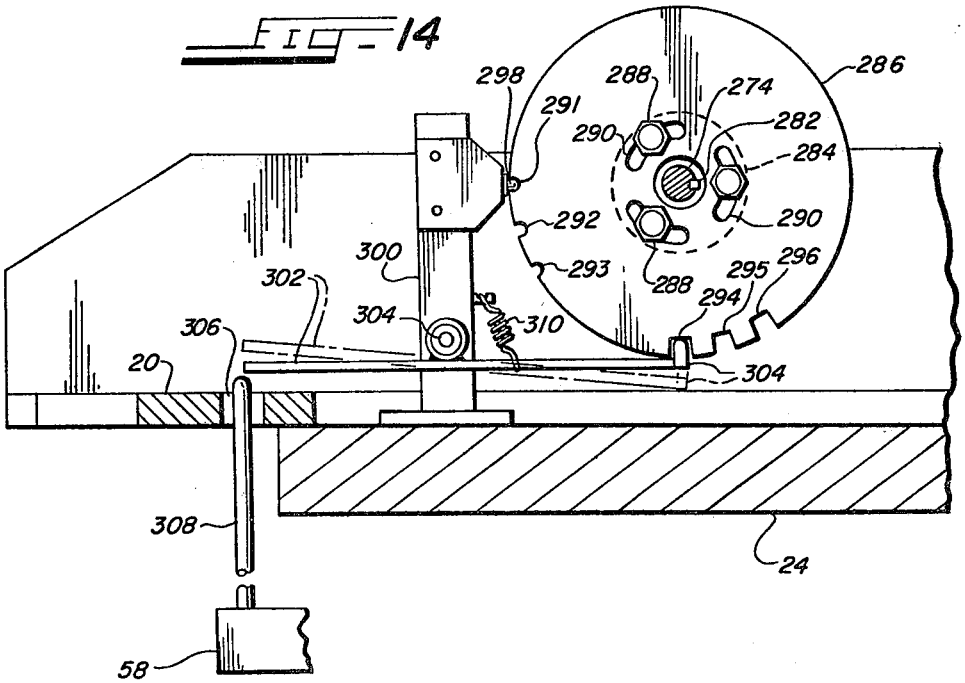

SHELF ARRANGEMENT FOR FREEZE DRYING APPARATUS

BACKGROUND OF THE INVENTION

1. Field of the Invention

The present invention relates to freeze drying apparatus, and more particularly, to shelf structures for utilization in freeze drying apparatus.

2. Description of the Prior Art

The method of freeze drying biological specimens and other materials such as medicine and food products by sublimation of ice in a vacuum has been known for over fifty years. It was not until shortly before World War II, however, that the true commercial potential of laboratory freeze dryers and the process of sublimation were recognized. Particularly, during World War II, substantial development was made in the equipment and techniques for the purposes of supplying medical products to the armed forces. Since that time, increased interest by food processors as well as pharmaceutical manufacturers has resulted in further development of freeze drying equipment. Thus, freeze drying has found application not only in the laboratory for various scientific purposes, but commercially as well.

Basically, the process of freeze drying involves the lowering of the temperature of a moisture-containing item or sample until it is in a completely solid state, i.e., until it is frozen. The sample is then maintained in the area of a very low absolute pressure or high vacuum and subjected to a controlled heat input. Application of the heat to the product at a controlled rate results in the water content of the frozen sample being sublimated (i.e., converted directly from a solid to a gas without passing through the liquid state). The gaseous water vapor is then effectively removed from the system by being refrozen onto a refrigerated condenser thereby protecting the vacuum pump oil from contamination by water vapor. The refrozen moisture can be removed from the condenser when the drying process is completed. The condenser can be located in the same chamber as the shelf assembly or in a separate condensation chamber. Representative examples of some prior art freeze drying apparatus are shown in U.S. Pat. Nos. 3,795,986-Sutherland et al., 3,950,963-Sutherland, 3,286,366-Seligman, and 3,271,874-Oppenheimer.

In the types of freeze drying apparatus which are used for commercial purposes, such as freeze drying medicines, the material to be dried is usually placed in glass vials or containers supported on a shelf arrangement within the drying chamber. The vials typically have stoppers partially inserted in the open ends thereof, but the stoppers have slots which allow the moisture to escape from the interior of the vial during the freeze drying process. However, once the drying process has been completed, the vials must be closed before the drying chamber is open to prevent contamination when moisture-containing atmosphere enters the drying chamber. Consequently, various types of shelf arrangements have been provided which allow the shelves to be raised one against the other so that the vials are squeezed "accordion style" between the shelves driving the stoppers into the vials thereby sealing the vials. Prior art shelf arrangements have experienced various problems such as misalignment of the high frictional forces due to sliding surfaces thereof which have restricted proper operation of the prior art shelf arrangements.

BRIEF DESCRIPTION OF THE INVENTION

The present invention is used in freeze drying apparatus of the type including a sealable vacuum tight drying chamber, a refrigerated condenser for condensing and freezing moisture removed from items being dried in the drying chamber, a vacuum pump connected to the drying chamber for evacuating the air from the drying chamber, and a cooling system for cooling the condenser. Such structure is well known in the art as disclosed in U.S. Pat. Nos. 3,795,986-Sutherland et al, 3,950,963-Sutherland, 3,286,366-Seligman, and 3,271,874-Oppenheimer.

The present invention is an improved shelf arrangement for use in the drying chamber of such freeze drying apparatus comprising a rigid frame assembly having an upper bracket and a lower bracket and spacing members holding the upper bracket and lower bracket in a spaced apart relationship. A multiplicity of elongated wire members are stretched in a vertical relationship between the upper and lower brackets, and stop means are mounted in predetermined positions along respective ones of the wire members. A multiplicity of shelf means for supporting items to be dried in the drying chamber are provided having flange means mounted on the shelf means in suitable positions to slidably engage respective ones of the wire members and rest against respective ones of the stop means so that corresponding ones of the shelf means are supported by the stop means in predetermined positions between the upper and lower brackets. Elevating means are mounted on the frame assembly and the elevating means are operably connected to the lowest shelf means of the multiplicity of shelf means to cause the lowest shelf means to move vertically. Drive means is provided for driving the elevating means, and the drive means is mounted externally of the drying chamber and extends through a wall of the drying chamber to engage and drive the elevating means so that upon operation of the drive means in a forward direction the lowest shelf means is caused to move vertically upward engaging higher shelf means causing all of the shelf means to be slidably moved vertically along the wire members until restrained by the upper bracket. Upon operation of the drive means in a reverse direction, the lowest shelf means is caused to move vertically downward to its original position and each higher shelf means descends along the wire members until respective ones of the flange means engage corresponding ones of the stop means so that the shelf means assume predetermined positions essentially equally spaced between the upper and lower brackets.

Since it is desirable that the shelves be perfectly horizontal, means are provided for adjusting the vertical position of the stop means. The means for adjusting the vertical position of the stop means comprise threaded members attached to one end of each of the wire members that extend upwardly through corresponding openings in the upper bracket. Threaded nuts are engaged on the threaded members above the openings in the upper bracket to secure the threaded members. Biasing means are mounted at the other end of the wire members and engage the lower bracket so that the wires are stretched between the brackets but can be moved vertically by turning the threaded nuts.

The elevating means for raising and lowering the shelf means comprises vertically arranged threaded screw members mounted for rotation between the upper and lower brackets. Mating threaded engaging means are mounted on the lowest shelf and means for causing the screw members to rotate in response to operation of the drive means is provided.

The drive means comprises a base plate, a motor mounted on the base plate having a drive shaft, a gear reduction mounted on the base plate operably connected to the drive shaft having an output shaft oriented essentially perpendicular to the base plate that rotates at some predetermined fraction of the rotation of the drive shaft. Means are provided for mounting the base plate on the drying chamber so that the base plate can pivot about the output shaft. Limit means are provided adjacent the base plate for limiting the pivoting of the base plate. The limit means includes adjustable torque sensing means that senses the torque exerted by the output shaft and causes the motor to cease operation when a predetermined torque is sensed. To absorb excessive transient forces of the motor, damping means is connected to the base plate thereby preventing the base plate from being rapidly pivoted in response to those transient forces.

The invention also incorporates locking means for selectively locking certain of the shelf means in a vertically elevated position so that the remaining shelves can be reoriented with respect to one another between the upper and lower brackets. Spacer means may be provided that are attachable to the wire members above the stop means for repositioning those shelf means not locked in the vertically elevated position.

Thus, it is a principal object of the present invention to provide a shelf arrangement for freeze drying apparatus which utilizes thin wire members to slidably support the shelves in the apparatus thereby reducing the possibility of frictional resistance on the sliding surfaces of the shelf arrangement.

Yet another object of the present invention is to provide means of adjusting stops on the wire members so that the position of the shelves can be varied to level the shelves within the apparatus.

Yet another object of the present invention is to provide a drive system for a shelf arrangement for freeze drying apparatus that senses the torque exerted by the output shaft of the system so that the system can be stopped when a predetermined torque is exceeded.

Yet another object of the present invention is to provide a damping system for the drive system of a shelf arrangement for freeze drying apparatus that allows adjustable damping of transient forces.

A further object of the present invention is to provide a progressive shelf latching mechanism for a shelf arrangement in freeze drying apparatus that allows one or more upper shelves to be latched in an elevated out-of-the-way position so that the remaining shelves can be redistributed positionally to allow larger items to be supported by the shelves.

Yet another object of the present invention is to provide unique spacer means for redistributing the position of the remaining shelves after the upper shelves have been latched.

These and other objects, advantages, and features of the present invention shall hereinafter appear, and for the purposes of illustration, but not for limitation, an exemplary embodiment of the present invention is illustrated in the accompanying drawings and described in the accompanying detailed description.

DESCRIPTION OF THE DRAWINGS

FIG. 7B is a side partially cross-sectional fragmentary view of the torque sensing arrangement of the drive mechanism illustrated in FIG. 7A.

FIG. 10 is a top partially fragmentary view of a damping hydraulic cylinder for use with the drive mechanism illustrated in FIGS. 7A, 7B, and 8.

FIG. 14 is a cross-sectional partially fragmentary view taken substantially along line 14—14 in FIG. 11.

FIG. 15A and FIG. 15B are an enlargement of the push rod and latch rods of the present invention as illustrated in FIG. 11 in their respective positions during operation.

DETAILED DESCRIPTION OF THE PREFERRED EMBODIMENT

Figure 1:
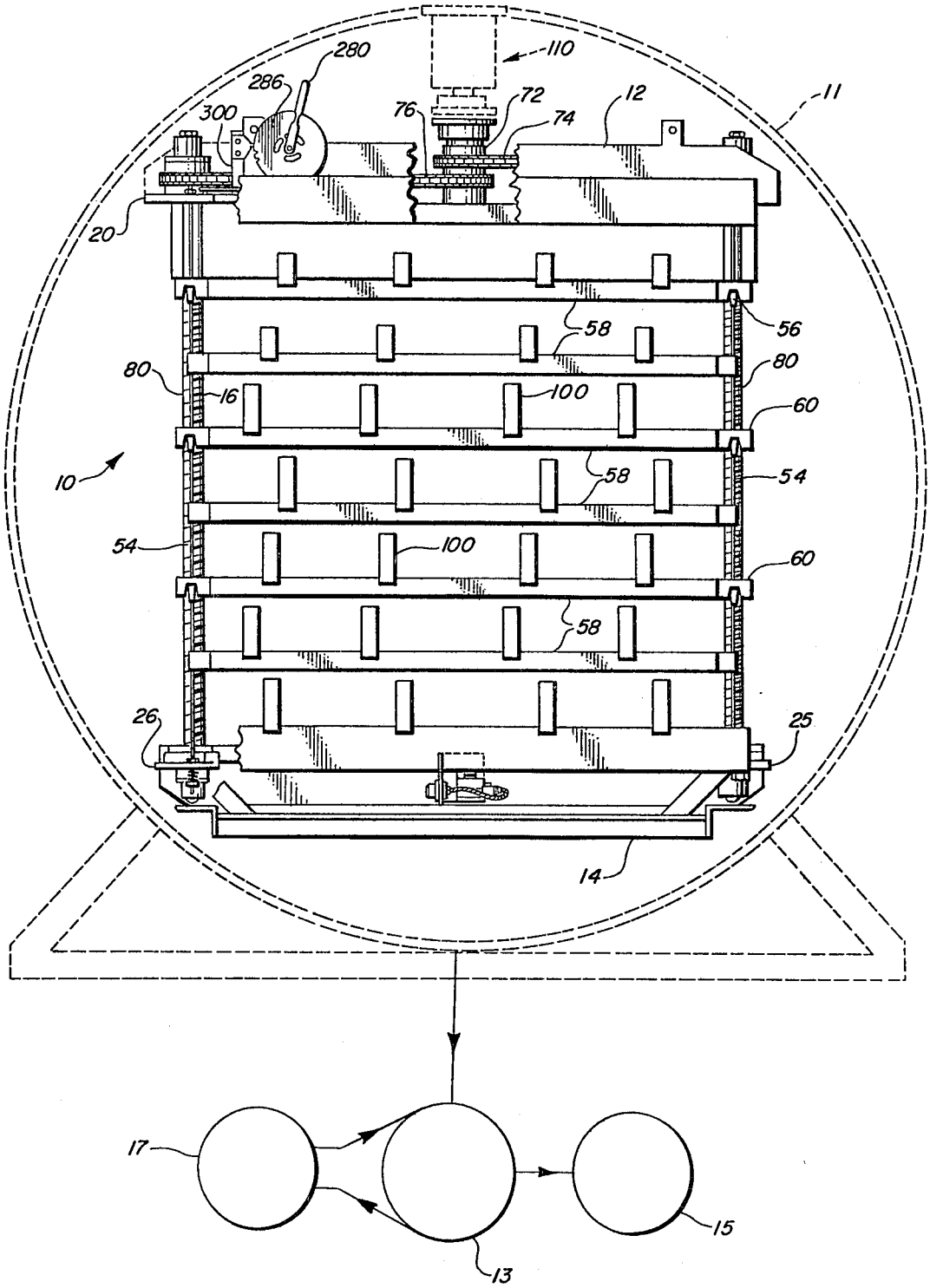
FIG. 1 is a front elevational view of a shelf arrangement in accordance with the present invention.
Figure 2:
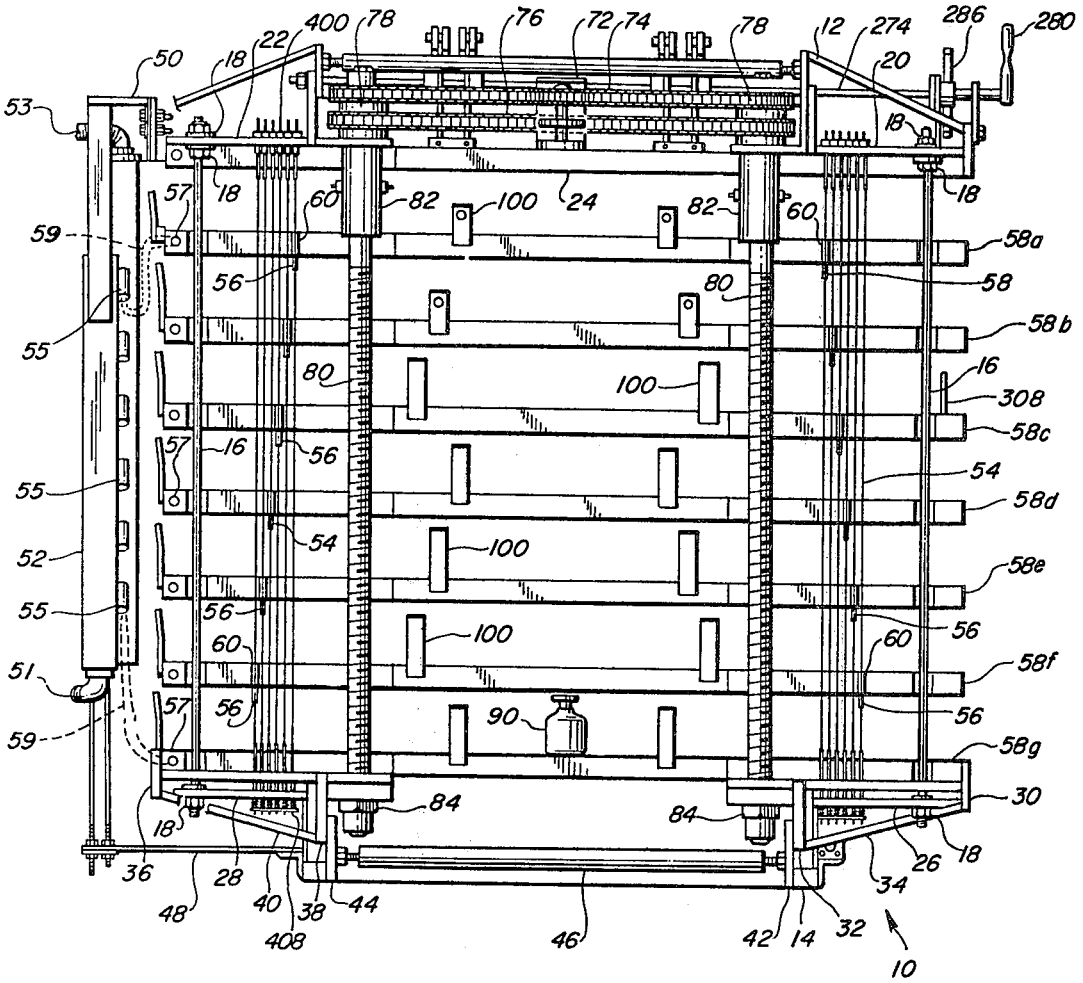
FIG. 2 is a side elevational view of the shelf arrangement illustrated in FIG. 1.

With respect to FIGS. 1 and 2, shelf assembly 10 is positioned in a drying chamber 11 (shown in dotted lines) of a freeze dryer. Graphically represented in FIG. 1 is a condensation chamber 13 that communicates with the drying chamber 11 which is used when the condenser is not located within the shelf chamber, a vacuum pump 15 that evacuates the air and moisture from the drying chamber 11 through the condensation chamber 13, and a cooling system 17 for refrigerating the condenser to refreeze the moisture removed from items being dried in the drying chamber 11.* The improved shelf assembly 10 comprises an upper bracket assembly 12 and a lower bracket assembly 14 which are held in a spaced relationship essentially parallel to one another by spacer members in the form of spacer rods 16. The ends of the spacer rods 16 are threaded and nuts 18 are used to mount the upper and lower bracket assemblies to the rod 16.

*The condenser 13 may take the form of a condensation chamber separate from the drying chamber 11, or a condenser element positioned within drying chamber 11, both of which structures are conventional in the art.

Upper bracket assembly 12 includes four cable support brackets 20, 21, 22, and 23 mounted on an upper shelf member 24. Only brackets 20 and 22 can be seen in FIG. 2 and brackets 21 and 23 can be seen in FIG. 11 which will be discussed later.

Lower bracket assembly 14 comprises four cable support and guide rod brackets 25, 26, 27, and 28, but only brackets 26 and 28 can be seen in FIG. 2.

The lower shelf 58*g* has an elongated end member 30 attached along one edge thereof and extending downwardly therefrom and a bottom member 32 attached long the bottom of the shelf and extending downwardly therefrom. A support member 34 connects the lower edge of end member 32 with the lower edge of end member 30 to form a rigid structure. Similarly, at the other end of lower shelf 58*g* there is another end member 36 joined along one edge and bottom member 38 joined along the bottom of the shelf and a support member 40 joined thereto in the same manner as bracket 26. Mounted on bottom members 32 and 38 are leveling flanges 42 and 44 between which are mounted on a bottom leveling rod 46.

Mounted in a cantilever fashion to lower bracket assembly 14 is a hose guide rod support arm 48. Two shorter manifold support arms 50 are mounted to the upper bracket assembly 12 and cantilevered from arms 50 are inlet and outlet manifolds 52. Manifold 52 has an intake 51, the other an outlet 53 and a series of ports 55 which communicate with ports 57 in shelf subassemblies 58 via flexible tubing 59 (only two of which are shown in dotted lines) to supply heated or cooled liquids as appropriate to hollow interiors of the shelf subassemblies.

Figure 4:
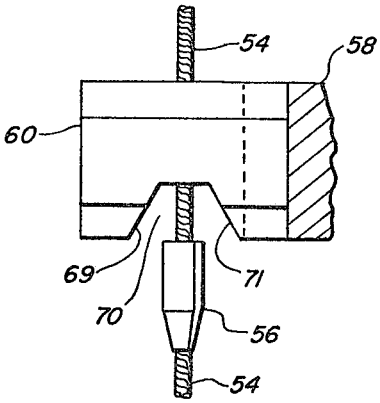
FIG. 4 is a side partially fragmentary view of the flange illustrated in FIG. 3.
Figure 3:
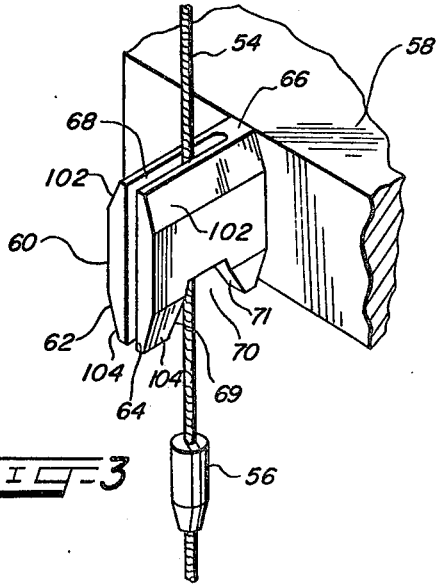
FIG. 3 is an upper perspective partially fragmentary view of a supporting flange attached to a shelf of the shelf arrangement of the present invention.

Stretched between upper brackets assembly 12 and lower bracket assembly 14 are a plurality of wire members 54. Wire members 54 are stretched between the upper and lower bracket assemblies 12 and 14 in a manner and by adjustable fittings that will be more fully described in more detail later. Stop members 56 are mounted on respective ones of wire members 54 in predetermined vertical positions by brazing or any other suitable means. Shelf subassemblies 58*a*–58*f* having guide flanges 60 mounted thereon and extending from the edge thereof are supported by the stop members 56 in a spaced relationship between the upper and lower brackets. With reference to FIGS. 3 and 4, it can be seen that guide flange 60 comprises two arms 62 and 64 which are integrally connected to a base portion 66 to form a slot 68 through which wire member 54 extends. Formed in the bottom edge of arms 62 and 64 is a centering groove 70 that has slanted sides 69 and 71 that receive stop member 56 so that stop member 56 is always returned to the same position in groove 70 when the shelves are lowered. Flanges 60 are of two different lengths since the horizontal placement of adjoining wires is staggered to avoid interference with the flanges on other shelves. Arms 62 and 64 of flange 60 have chamfered or tapered upper and lower surfaces 102 and 104 which aid in allowing the flange members to pass adjacent stop members 56 on adjacent wire members 54 as the shelves are raised and lowered. Thus, the shelves will not get "hung up" on adjoining stop members during the raising and lowering process.

As can be seen, each of the shelf subassemblies 58*a* through *f* are free to slide up and down along the wire members 54. Normally, the shelf subassemblies 58*a*–58*f* are in the positions illustrated in FIGS. 1 and 2 resting on their respective stop members 56.

To move the shelf subassemblies up and down, elevating and drive means are provided. With reference to FIGS. 1 and 2, mounted to an upper shelf member 24 of upper bracket assembly 12 is a center sprocket assembly 72 over which are trained chains 74 and 76. The other ends of chains 74 and 76 are trained over follower sprockets 78 mounted to the upper end of acme screw members 80 (See FIG. 11 where chains 74 and 76 are illustrated by dotted lines). One end of acme screw members 80 are supported by a thrust bearing 82 mounted on upper bracket assembly 12. The other end of screw members 80 are threaded through drive nuts 84 mounted on the lowest shelf subassembly 58*g*. When center sprocket 72 is rotated, sprockets 78 are also rotated causing acme screw members 80 to rotate. Rotation of screw members 80 in one direction (a foreward direction) causes the drive nuts to move the lowest shelf subassembly 58*g* in an upward direction so that flanges 60 slide along wire members 54 until the lowest shelf 58*g* contacts the next highest shelf 58*f* pushing it upwardly. This process continues until all shelves 58*a*–58*g* have been moved up wire members 54 until they are against upper bracket assembly 12. Rotation of screw members 80 in an opposite or reverse direction causes the shelf subassemblies to lower. Mounted along the edges of shelf subassemblies 58*a*–58*g* are upwardly extending guide members 100 which serve to align the shelves as they are moved upward.

Figure 6:
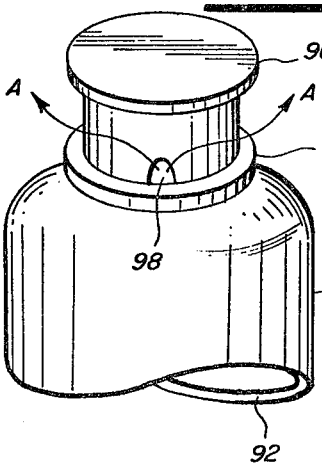
FIG. 6 is an upper perspective partially fragmentary view of a glass vial and stopper that would be positioned on the shelves of the shelf arrangement illustrated in FIGS. 1 and 2.

Ordinarily, during the freeze drying process, a plurality of glass vials 90 (for simplicity only one of which is shown in FIG. 2) would be positioned on all of the shelf subassemblies 58. With reference to FIG. 6, the vials 90 may comprise a hollow glass body 92 having a necked down opening 94 at the upper end thereof into which a stopper 96 is partially inserted. Stopper 96 has at least one slot 98 along the edge thereof which allows moisture to escape from the material within the vial 90 which is being dried in the freeze dryer. The removal of the moisture is graphically illustrated by the arrows A in FIG. 6 which represents water vapor being removed from the material within vial 90 by the freeze drying process. Once the material in all of the plurality of vials on all of the shelf subassemblies 58 has been freeze dried, it is necessary to drive the stoppers 96 down into the vials 90 so that the material within the vials is not contaminated by moisture in the atmosphere when the drying chamber door is open. Thus, by moving the shelf subassemblies 58*a*–58*g* upwardly by the rotation of acme screw members 80, the plurality of vials on all of the shelves are squeezed between the shelves pushing the stoppers into the vials sealing them from further moisture contamination.

Figure 8:
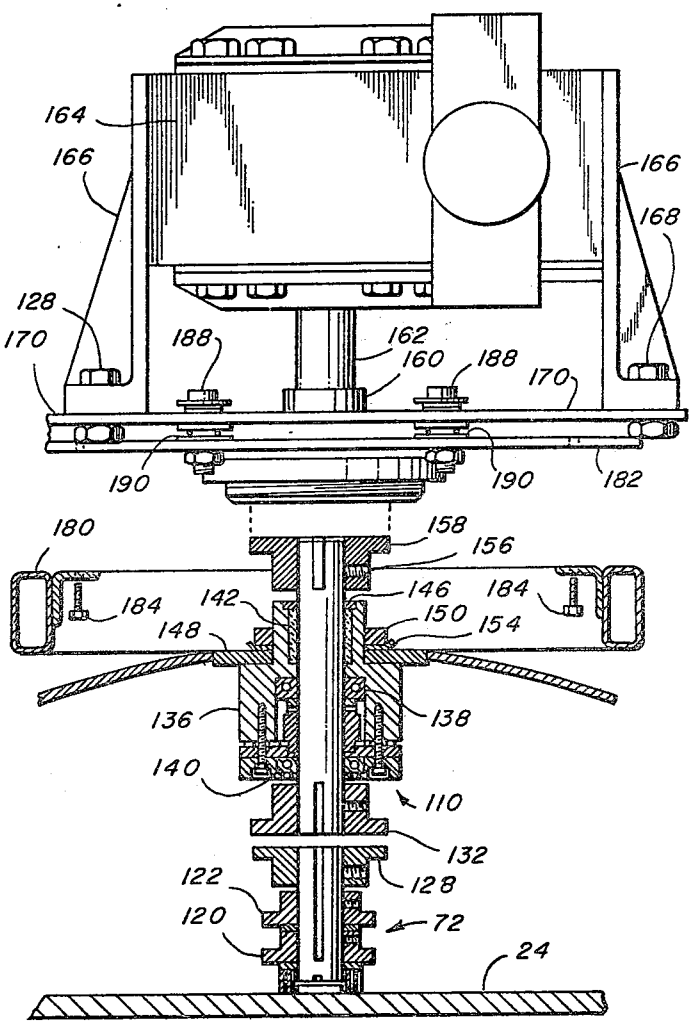
FIG. 8 is a side partially cross-sectional exploded view of the drive mechanism and coupling assembly illustrated in FIG. 7A.
Figure 9:
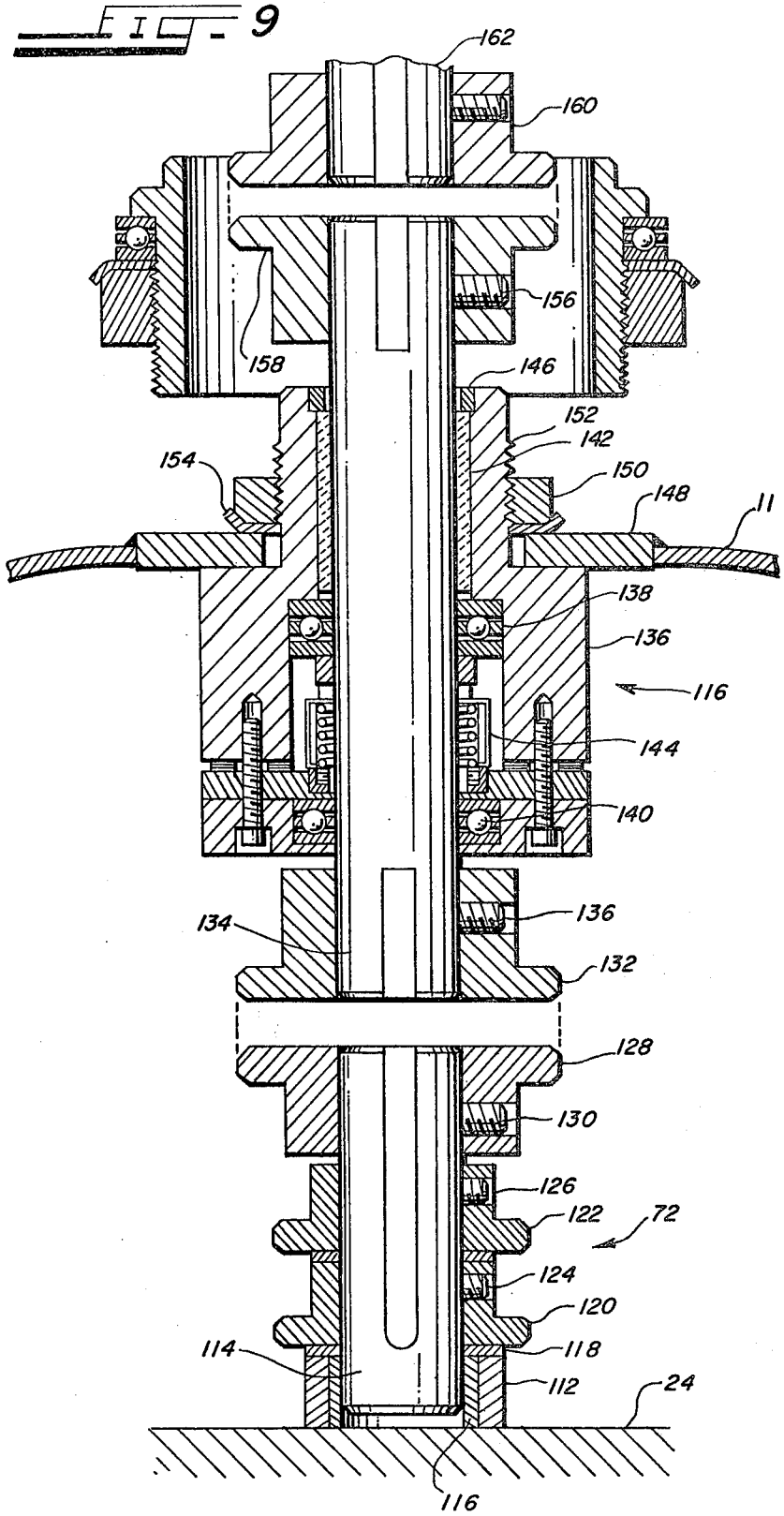
FIG. 9 is an enlarged view of the coupling assembly between the drive mechanism and the shelf arrangement illustrated in FIG. 8.

With reference to FIG. 1, at the top of vacuum drying chamber 11 and connected to central sprocket 72 is drive coupling assembly 110 (shown in dotted lines in FIG. 1). With reference to FIGS. 8 and 9, are more detailed illustration of drive coupling assembly 110 is illustrated. With specific reference to FIG. 9, it can be seen that center sprocket assembly 72 is mounted on upper shelf member 24 by an annular sleeve 112 which rotatably supports the end of a shaft 114 on a bearing sleeve 116 and a bearing ring 118. A first sprocket 120 and a second sprocket 122 are mounted on shaft 114 by set screws 124 and 126. A chain coupler 128 is mounted to the upper end of shaft 114 by a set screw 130.

Positioned immediately above chain coupler sprocket 128 is a corresponding chain coupler sprocket 132 which is mounted to a shaft 134 by a set screw 136. Ordinarily, chain coupler sprockets 128 and 132 are positioned against one another and a coupling chain (not shown) engages both sprockets to provide a flexible coupling between shafts 114 and 134. Shaft 134 is supported for rotation by a bearing housing 136 that houses ball bearings 138 and 140 and bushing 142. A mechanical spring loaded seal 144 and an annular seal 146 help to provide a vacuum-tight seal around shaft 134. Bearing housing 136 is mounted on a flat plate 148 which is welded to the top of the vacuum-drying chamber 11 by a threaded collar nut 150 which is screwed on to threads 152 and locked in position by lock washer 154. Attached to the upper end of shaft 134 by a set screw 156 is another chain coupler sprocket 158.

With reference to FIGS. 8 and 9, a chain coupler sprocket 160 is mounted to the end of an output shaft 162 of a gear reduction assembly 164. Gear reduction 164 is mounted on upwardly extending flange brackets 166 which are mounted by bolts 168 to a base plate 170.

Figure 7A:
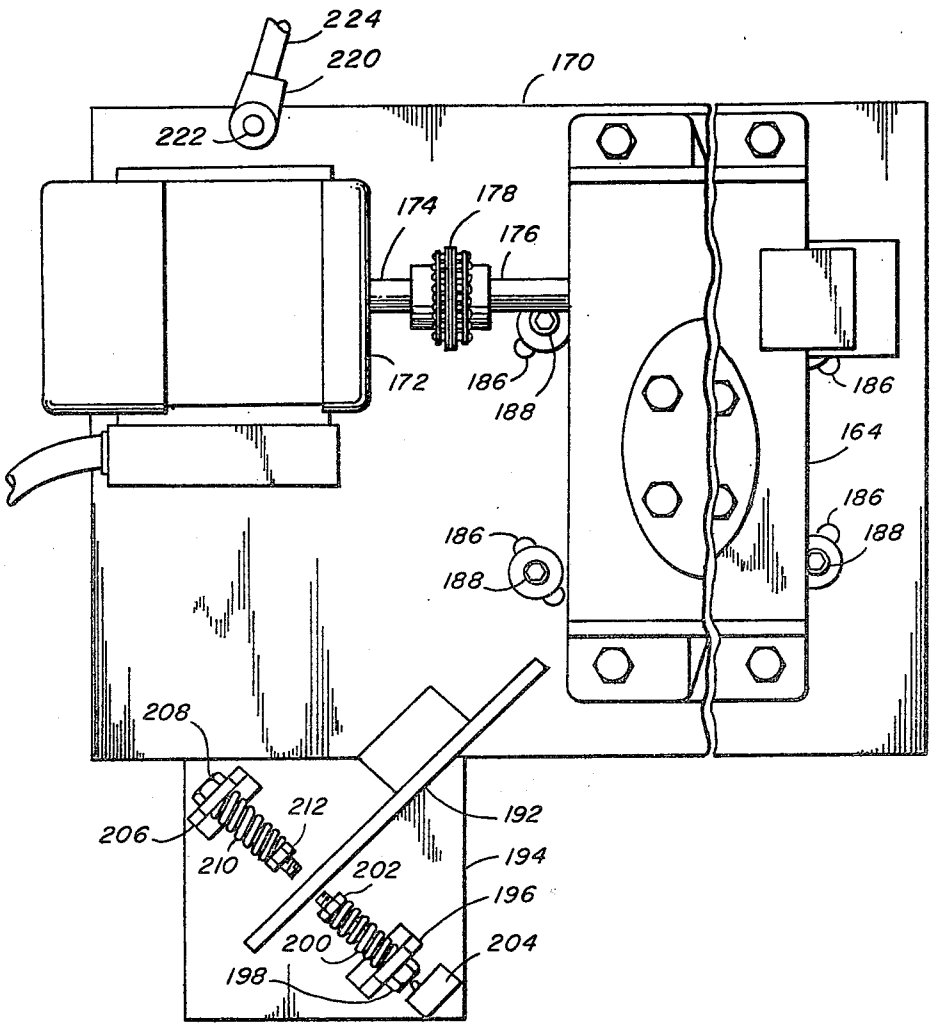
FIG. 7A is a top partially fragmentary view of a drive mechanism for use with the present invention.

With reference to FIG. 7A, also mounted on base plate 170 is a motor 172 having a drive shaft 174 coupled to the input shaft 176 of gear reduction 164 by a flexible chain coupling 178. Gear reduction 164 has a plurality of gears mounted internally (not shown) that reduce the number of revolutions of the input shaft 176 with respect to the output shaft 162 so that the output shaft 162 turns at some predetermined fraction of the number of revolutions of drive shaft 174 of motor 172.

With reference to FIG. 8, a cross tube support frame 180 is rigidly mounted on drying chamber 11 and a lower plate 182 is mounted normally on support frame 180 by bolts 184 after lower plate 182 is lowered and positioned on the top of frame 180 (FIG. 8 is an exploded view).

With reference to FIGS. 7A and 8, base plate 170 is pivotably mounted on lower plate 182 so that base plate 170 can rotate about shaft 162. Specifically, base plate 170 has curved slot 186 aligned along a portion of the circumference of a circle whose center lies at the center axis of shaft 162. Shaft 162 and sprocket 160 extend through an opening in base plate 170, and there is a corresponding opening in lower plate 182. Mounted on lower plate 182 are four bolts 188 which extend through the curved slots 186, and bearings 190 are positioned around bolts 188 between plates 170 and 182 so that base plate 170 can freely pivot about shaft 162 along curved slots 186.

With reference to FIG. 7A, mounted on base plate 170 is an outwardly extending arm 192. Arm 192 is mounted in a cantilever fashion so that the free end thereof pivots with base plate 170.

Mounted on support frame 180 is a stop plate 194. With reference to FIGS. 7A and 7B, mounted on stop plate 194 is an upwardly extending L shaped flange 196 having an opening through the upper end thereof through which a bolt 198 is positioned. A coil spring 200 is positioned around the end of bolt 198 and held against flange 196 by a nut 202. Arm 192 is positioned to engage the end of bolt 198 as base plate 170 pivots and when sufficient force is exerted, bolt 198 is moved laterally against the biasing of spring 200 until the hex end of bolt 198 engages a microswitch 204. Microswitch 204 controls the operation of motor 172 so that when actuated, motor 172 is turned off. Positioned on the other side of arm 192 is a similar stop assembly comprising flange 206, bolt 208, spring 210 and nut 212, however, no microswitch is needed on that side.

It can be seen that since base plate 170 pivots about output shaft 162, when torque is exerted on output shaft 162 by motor 172 to raise the shelves, arm 192 is caused to engage the end of bolt 198. Similarly, lowering of the shelves causes arm 192 to engage bolt 208. Thus, it can be seen that the displacement of plate 170 can be controlled by the adjustment of nuts 202 and 212 so that the spring biasing force on springs 200 and 210 is adjusted. Arm 192 engages bolt 198 when the shelf subassemblies **58*a*–58*g* are being raised and when the torque exerted to raise those shelf subassemblies reaches a predetermined level, the bolt 198 is deflected against switch 204 thereby shutting off the motor. This adjustable torque sensing means allows control of the stoppering pressure applied by the shelves so that it can be assured that all of the vials 90 have their respective stoppers pushed into the vial before motor 172 is turned off but the force is not great enough to break the glass vials 90**.

With reference to FIGS. 7A and 10, a clevis 220 is mounted by a pin 222 to base plate 170. Clevis 220 is connected to a shaft 224 of a hydraulic cylinder 226. Hydraulic cylinder 226 has a hollow interior in which a hydraulic piston 228 (shown in dotted lines in FIG. 10) is disposed. Piston 228 is mounted on shaft 224 so that movement of shaft 224 causes piston 228 to move. The respective hollow interiors of hydraulic cylinder 226 on each side of piston 228 communicate with hollow output conduits 230 and 232 respectively. Conduit 232 is connected to one side of a needle valve 234 and conduit 230 is connected to a tee and plug assembly 236 which in turn is connected to the other side of needle valve 234. Thus, the hollow interiors of cylinder 226 on each side of the piston 228 communicate through needle valve 234. Accordingly, any torque forces exerted on output shaft 162 are transmitted through shaft 224 to cause piston 228 to move. The hollow interior of cylinder 226 and conduits 230 and 232 are filled with hydraulic fluid and the movement of piston 228 in either direction causes that hydraulic fluid to flow through needle valve 234. By adjusting needle valve 234, rapid transient forces on shaft 162 can be dampened to prevent base plate 170 from pivoting rapidly as a result of transient forces. However, continuous forces caused, for example, by the raising of the shelf subassemblies **58*a*–58*g* will cause a pivoting of base plate 170 against the stop bolts 198 and 208** as previously described.

Figure 11:
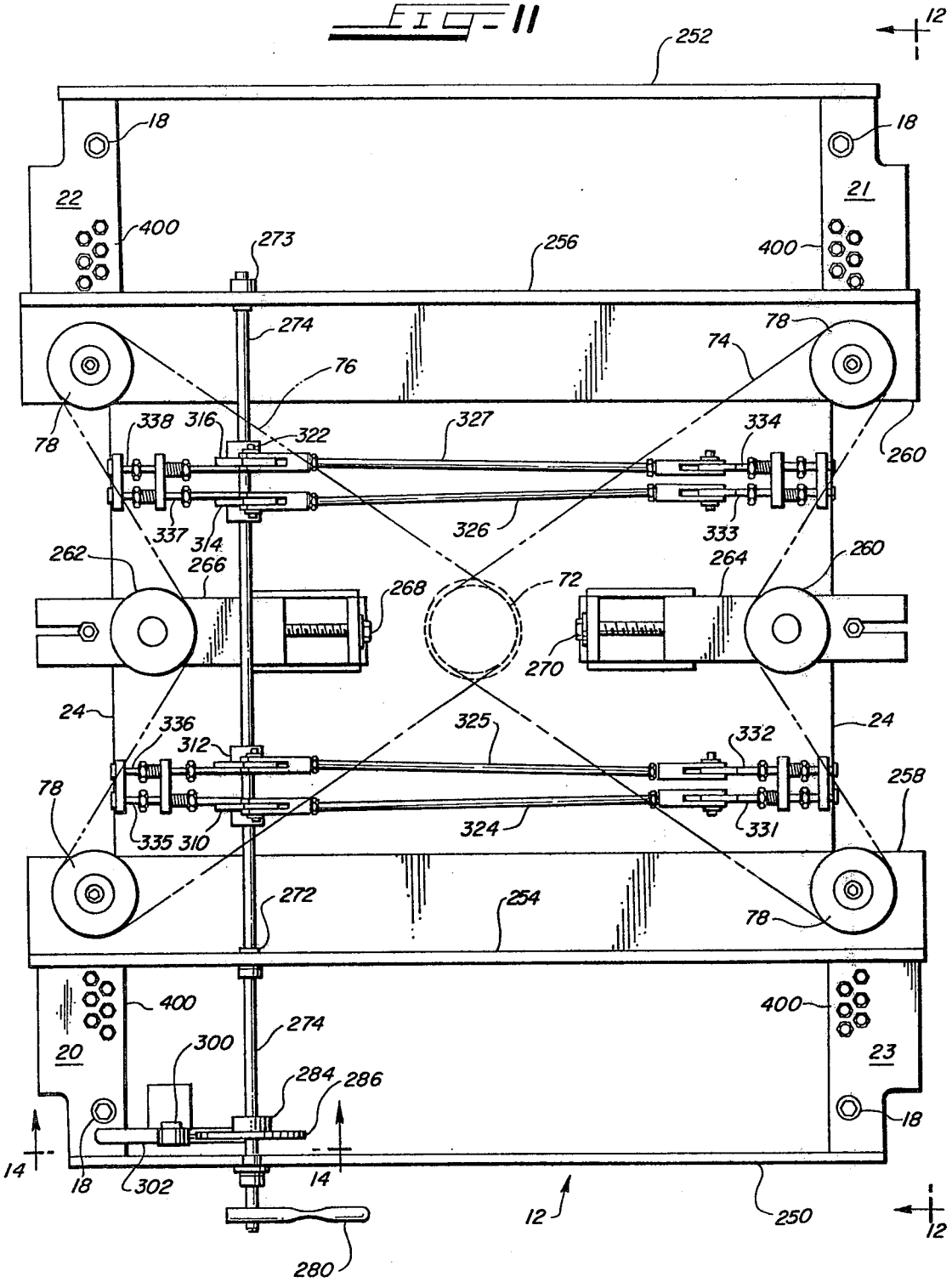
FIG. 11 is a top view of the shelf arrangement illustrated in FIG. 1.
Figure 12:
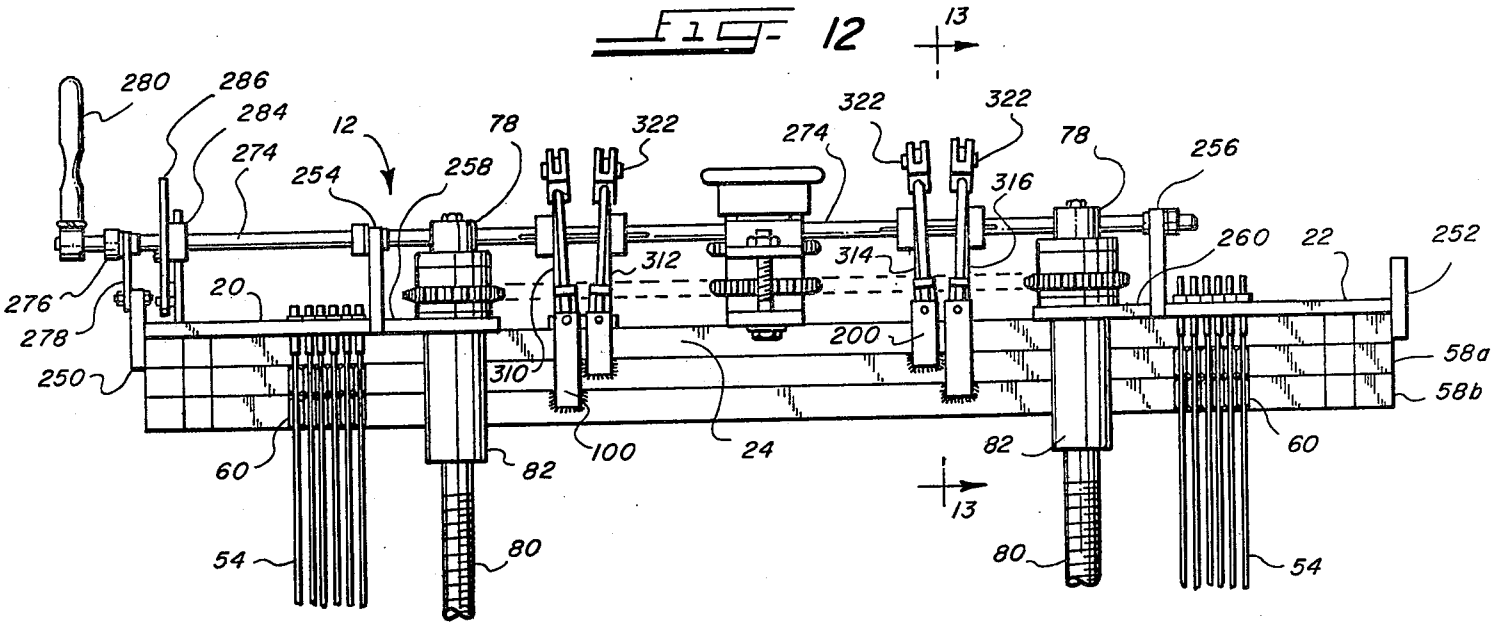
FIG. 12 is a side, partially fragmentary view taken substantially along line 12—12 in FIG. 11.

With reference to FIGS. 11 and 12, upper bracket assembly 12 is more specifically depicted. It can be seen that cable support brackets 20 and 23 are connected by an end member 250 and cable support brackets 21 and 22 are connected by an end member 252. Upwardly extending members 254 are 256 are connected to the other side of brackets 20, 21, 22, and 23 respectively. Sprocket support members 258 and 260 are mounted against members 254 and 256 respectively and extend outwardly from the edge of upper shelf member 24. Thrust bearings 82 are mounted to the ends of sprocket supports 258 and 260. Chains 74 and 76 are trained over sprockets 78 and central sprocket assembly 72 as indicated by the dotted lines in FIG. 11. Chain tightening sprockets 260 and 262 are mounted for rotation on sliding brackets 264 and 266 and the tension on chains 74 and 76 can be adjusted by rotating bolts 268 and 270.

Mounted for rotation through bearings 272 and 273 mounted on members 254 and 256, respectively, is a shaft 274. An end of shaft 274 is also supported by a bearing 276 mounted on the end of a bracket 278 attached to end member 250. Mounted on the end of shaft 274 is a lever handle 280 which can be grasped and pivoted by a human operator.

With reference to FIGS. 11, 12, and 14, rigidly mounted to shaft 274 by a key 282 (See FIG. 14) is plate mounting block 284. A circular index plate 286 is adjustably mounted to block 284 by bolts 288 positioned through curve slots 290 in plate 286. Thus, as shaft 274 is rotated by handle 280, plate 286 will also rotate through a corresponding angular displacement.

Evenly spaced along a portion of the circumference of plate 286 separated by approximately 13½° are three index indentations 291, 292, and 293. Also equally evenly spaced at approximately the same 13½° separation along another portion of the circumference of plate 286 are locking slots 294, 295, and 296. A spring loaded detent 298 is positioned to engage indentations 291, 292, and 293. Detent 298 is mounted on an upwardly extending member 300 which is mounted on upper shelf member 24. Detent 298 is spring biased but will allow plate 286 to be pivoted between the index indentations 291, 292, and 293 when lever handle 280 is pivoted.

With reference to FIG. 14, a lever 302 is pivotably mounted by a pin 304 on member 300. One end of lever 302 has a pawl 304 mounted thereon which can engage locking slots 294, 295, and 296. The other end of lever 302 is positioned over an opening 306 in bracket 20. A push rod 308 is mounted on the third shelf subassembly **58*c* below the upper shelf member 24. As can be seen in FIG. 14, when the third shelf assembly 58*c* is raised, push rod 308 engages the end of lever 302 pivoting lever 302 until pawl 304 disengages locking slot 294. At this time, lever handle 280 can be utilized to rotate shaft 274 until spring detent 298 engages one of indentations 292 or 293. As can be seen, when the third shelf subassembly 58 is lowered, spring 210 causes lever 302 to pivot back to its original position until pawl 304 engages one of the locking slots 294–296. Consequently, there are three index positions for plate 286, and in each of the index positions, shaft 274** is pivoted and locked in a specific angular position.

Figure 13:
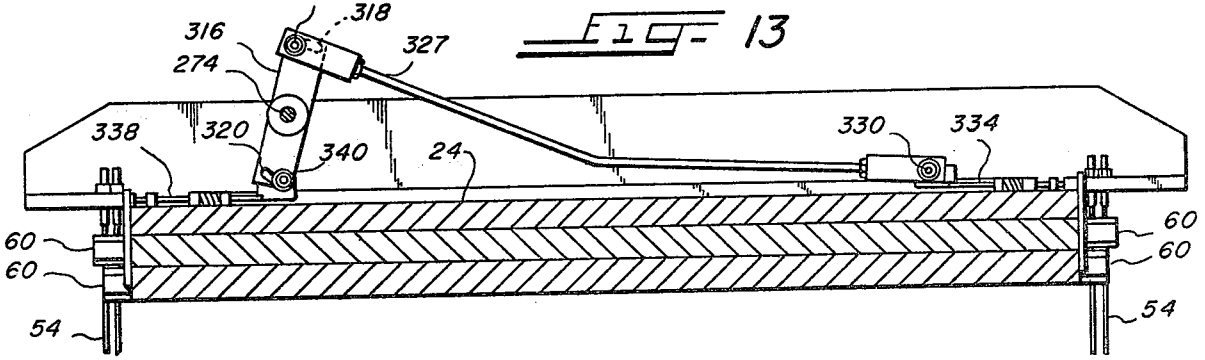
FIG. 13 is a cross-sectional view taken substantially along line 13—13 in FIG. 12.

With reference to FIGS. 11, 12, and 13, mounted along shaft 274 intermediate its ends are four cam members 310, 312, 314, and 316 which rotate with shaft 274. Cam members 310–316 are each mounted at approximately their center to shaft 274, and each have slots 318 and 320 (see FIG. 13) through opposite ends thereof. A pin 322 through slot 318 mounts one end of a respective push rod 324, 325, 326, and 327 to a respective cam member 310–316.

Pinned to the other end of each of push rods 324–327 by pines 330 are four latch rods 331, 332, 333, and 334. Similarly, latch rods 335, 336, 337, and 338 are directly connected by pins 340 through slots 320 in the ends of respective cam members 310 through 316.

For simplicity, operation of latch rods will be described with respect to latch rods 333 and 334. It should be understood that the other latch rods operate in a corresponding manner. With reference to FIG. 15A, when the shaft 274 is in the first index position with detent 298 in indentation 291, cam members 314 and 316 are oriented such that rod 326 is pulled in the direction of arrow B in FIG. 15A causing latch rod 333 to be moved in the direction of arrow B so that stop 342 compresses spring 344 withdrawing the end 346 of latch rod 333 into support block 348. Similarly, in the first index position, cam 316 releases rod 327 allowing spring 350 to push against stop 352 so that rod 334 assumes the position illustrated in FIG. 15A with the end 354 withdrawn into block 348.

When shaft 274 is rotated to its second index position so that detent 298 engages indentation 292, the cams 310–316 are pivoted so that cam 314 releases rod 326 and spring 344 pushes the end 346 of latch rod 333 to right as viewed in FIG. 15B until it extends through engaging means in the form of an opening in one of the guide members 100 welded to the edge of the first or upper most shelf subassembly **58*a*. As previously pointed out, shaft 274 can only be rotated when all of the shelves have been moved to their raised position. In the second index position, the slot 318 in the end of cam 316 does not engage pins 322 attached to push rod 327 so latch rod 334 remains in the withdrawn position illustrated in FIG. 15A. However, when the shaft 274 is rotated to the third index position so that detent 298 engages indentation 293, cam 316 is pivoted another 13½° and the end of slot 318 engages pin 322 pushing rod 327 and connected latch rod 334 to the right as viewed in FIG. 15A compressing spring 350 between support block 360 and stop 352 causing end 354 to engage the opening in the guide member 100 attached to second shelf subassembly 58B thereby locking the second subshelf assembly 58B against upper shelf assembly 24 as illustrated in FIG. 12**.

Thus, in the embodiment illustrated, a selective latch arrangement is shown whereby either one or two shelf subassemblies can be latched in an out-of-the-way position thereby effectively reducing the number of usable shelves of the shelf assembly. Often, it is desirable to rearrange the spacing between the shelves so that larger vials or containers can be placed on the shelves for freeze drying. Consequently, the latching arrangement illustrated herein, allows an option of either latching one or two shelves depending upon the desired spacing between the shelves. Once the desired number of shelves has been latched, the remaining shelves can be lowered so that pawl 304 engages a corresponding locking slot 294–296 so that the shelves cannot be accidentally unlatched.

Figure 16:
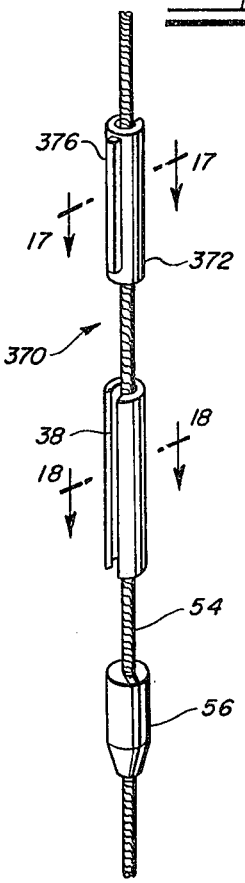
FIG. 16 is an exploded view of a spacer means in accordance with the present invention.
Figure 17:
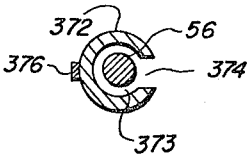
FIG. 17 is a cross-sectional view taken substantially along line 17—17 in FIG. 16.
Figure 18:
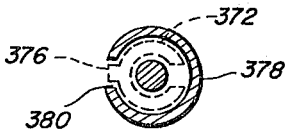
FIG. 18 is a cross-sectional view taken substantially along line 18—18 in FIG. 16.

Once the desired number of shelves has been latched up against the upper bracket assembly 12, the spacing between the remaining lowered shelves must be redistributed. To achieve this respacing, spacing means in the form of a two-piece interlocking spacer member as illustrated in FIGS. 16, 17, and 18 may be used. The spacing member 370 comprises a cylindrically-shaped inner spacer 372 having a slot 374 extending along a entire side thereof that is wide enough to allow wire member 56 to pass through to the hollow interior 373 of the cylindrical inner spacer 372. Inner spacer 372 also has a ridge 376 extending from the exterior surface thereof along a surface opposite slot 374. With reference to FIG. 18, outer cylindrical sleeve 378 has a hollow interior that is dimensioned to have a sliding fit around the exterior of inner spacer 372 (as illustrated by the dotted lines in FIG. 18). Outer sleeve 378 has a slot 380 along the length thereof which is wide enough to receive ridge 376 and wire member 54. Thus, once sleeve 378 and spacer 372 have been jointed together, they are effectively locked around wire member 54 and can rest on top of stop members 56 so that flange 60 is supported on the spacer assembly 370. In this manner, the spacing between the respective shelves can be redistributed by selecting appropriate lengths of spacer members 370.

Figure 5A:
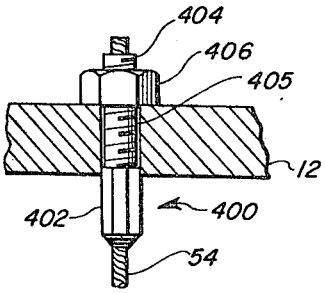
FIG. 5A is a cross-sectional partially fragmentary view of an upper wire adjusting stop assembly in accordance with the present invention.

It is also sometimes desirable to adjust wire members 54 so that the relative vertical position of stop members 56 can be varied to level the shelf subassemblies 58 and assure that all four flanges 60 engage the stop members 56. With reference to FIG. 5A, one end of each of the wire members 54 is attached to a stop assembly 400 that has a hexagonally-shaped portion 402 at one end, and a threaded portion 404 at the other end. Stop assembly 400 is welded or brazed to wire member 54 and extends through an opening 405 in the upper bracket 12 and prevented from being withdrawn from the opening 405 by a nut 406 threaded on the threaded portion 404.

Figure 5B:
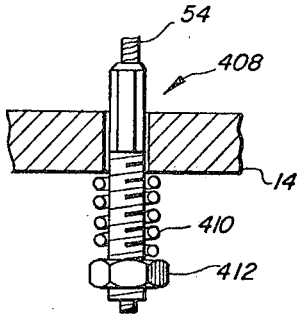
FIG. 5B is a cross-sectional partially fragmentary view of a lower wire adjusting stop assembly in accordance with the present invention.

With reference to FIG. 5B, mounted on the other end of each of the wire members 54 is another stop assembly 408 which is virtually identical to stop member 400 except that it is slightly longer so that a compression spring 410 can be positioned between the lower bracket 14 and a nut 412.

Thus, it can be seem from FIGS. 5A and 5B that by adjusting nut 406, the relative vertical position of wire member 54 can be varied as a result of the compression of spring 410 thereby allowing small adjustments of the relative vertical position of the stop members 56 attached to the wire members 54. This adjustment allows the shelf members to be leveled with respect to one another to assure that the materials in the vials 90 being dried remain in a level position as well as to assure that all of the flanges 60 engage the stop members.

The advantages of the present invention should be apparent. The wire members 54 which suspend the various shelves are flexible enough to allow the lower shelves in the assembly to be moved upwardly during the stoppering process without interference. Also, the individual shelf heights of the shelves may be altered as previously described without affecting any other shelf; individual shelves may be removed from the assembly for repair without affecting the location or alignment of any other shelf, and the individual shelves may be leveled without affecting the location or alignment of the other shelves. Since the wire members 54 tend to become straight under tension, the shelves will tend to slide upwardly without binding as the wire members pass through the slotted flanges 60. In the prior art, rigid rods were used, and alignment was critical since binding problems could result.

The drive arrangement of the present invention as illustrated also provides advantages over the prior art. Since the base plate 170 tends to rotate about the output shaft 162, any torque exerted on the output shaft is immediately transmitted to arm 192 so that the torque can be sensed by the spring-loaded stop bolts 198 and 208. Thus, there is a direct measurement of the output torque. Further, the adjustable damping action provided by the hydraulic cylinder and needle valve permit adjustable control over the response speed when transient torque forces are exerted on the output shaft 162.

The latching arrangement as illustrated in FIGS. 11, 12, and 13 permit selective latching of one or more of the shelves and the position of the remaining shelves can be redistributed. The positive locking action in the respective index positions precludes the inadvertent release of the shelves. Further, since all four latch rods for each shelf will be latched simultaneously by one physical operation (as opposed to four separate latching operations at each corner of the shelf) latching of the shelves in a raised position is assured.

It should be apparent from the foregoing that various modifications, alterations, and changes may be made to the embodiment as illustrated and described herein without departing from the spirit and scope of the present invention as defined in the appended claims.

I claim:

1. In a freeze dryer of the type including a sealable vacuum-tight drying chamber, a refrigerated condenser for condensing and freezing moisture removed from items being dried in the drying chamber, a vacuum pump connected to the drying chamber for evacuating the air from the drying chamber, and a cooling system for cooling the condenser; and improved shelf arrangement for use in the drying chamber comprising:

a rigid frame assembly having an upper bracket, a lower bracket and spacing members holding said upper bracket and said lower bracket in a spaced-apart relationship;

a plurality of shelves movably mounted between said upper bracket and said lower bracket in a spaced-apart relationship, certain of said shelves having engaging means extending upwardly from the edge of said shelves;

means for moving said plurality of shelves vertically;

locking means for locking certain of said shelves in a vertically elevated position, said locking means being selectively movable between a multiplicity of index positions when said plurality of shelves are moved vertically upwardly until retained by said upper bracket, a first of said index positions being a non-locking position that allows all shelves to be lowered, a second of said index positions causing said locking means to engage said engaging means on a topmost shelf of said plurality of shelves, so that it cannot be lowered, the remainder of said shelves being free to be lowered, a third of said index positions causing said locking means to engage said engaging means on a second topmost shelf of said plurality of shelves so that the second topmost shelf cannot be lowered, the remainder of said shelves being free to be lowered.

2. An improvement, as claimed in claim 1, wherein said locking means further comprises:

a shaft mounted for rotation on said upper bracket;

means for rotating said shaft;

a circular plate mounted on said shaft, said circular plate having indentations evenly spaced along a portion of the circumference of said circular plate at each of said index positions, and locking slots similarly evenly spaced along another portion of the circumference of said circular plate;

spring biased detent means releasably engaging said indentations;

a lever member pivotably mounted intermediate opposite ends thereof, one end of said lever member having a pawl mounted thereon adapted to engage said locking slots on said circular plate thereby locking said shaft;

biasing means normally brazing said lever member so that said pawl normally engages said locking slots;

push means mounted on one of said shelves that is always to be lowered, said push means engaging the other end of said lever member when said shelves are moved vertically upwardly against said upper bracket causing said pawl to disengage said locking slots so that said shaft can rotate;

a plurality of cam means mounted on said shaft for rotation with said shaft;

a plurality of push rod means engaging said cam means, said push rod means being movable in response to rotation of said cam means by said shaft;

a plurality of latch rod means mounted for movement between a first non-engaging position and a second engaging position on said upper shelf, respective ones of said latch rod means operably connected to corresponding ones of said push rod means so that at said first index position, all of said latch rods remain in their first non-engaging position so that all of said shelves can be lowered, and at said second index position, certain of said latch rod means are moved to engage said engaging means on the topmost shelf of said plurality of shelves, and at said third index position certain others of said latch rod means move to the second engaging position to engage the engaging means on the second topmost shelf of said plurality of shelves.

3. In an apparatus having a mechanism to be rotatably driven, an improved driving means comprising:

a base plate;

a motor means mounted on the base plate having an output shaft positioned essentially perpendicular to said base plate;

means for mounting said base plate on the apparatus so that said base plate can pivot about said output shaft;

adjustable limit means mounted adjacent said base plate for limiting the pivoting of said base plate, said limit means including adjustable torque sensing means that senses the torque exerted by said output shaft and causes said motor to cease operation when a predetermined torque is sensed.

damping means connected to said base plate for absorbing transient forces, the capacity of said damping means to absorb transient forces being directly related to the magnitude of such transient forces, thereby preventing said base plate from being rapidly pivoted in response to transient forces.

4. An improvement, as claimed in claim 3, wherein said means for mounting comprises:

a lower plate stationarily mounted to the apparatus, said lower plate having an opening through which said output shaft extends;

a plurality of bolts mounted on said lower plate, said bolts being positioned an equal distance from a center of said opening through which said output shaft extends; said bolts extending through curved slots in said base plate, said curved slots aligned along portions of a circle the radius of which equals the distance said bolts are positioned away from the center of said opening through which said output shaft extends;

means for slidably separating said lower plate from said base plate so that said base plate will rotate freely relative to said lower plate around said output shaft.

5. An improvement, as claimed in claim 3, wherein said damping means comprises:

a hydraulic cylinder having a movable piston positioned within said cylinder and a shaft connected to said piston, said shaft being connected to said base plate;

an adjustable needle valve;

a first conduit connecting one side of the said hydraulic cylinder on one side of said piston to one side of said needle valve;

a second conduit connecting the other side of said hydraulic cylinder on the other side of said piston to the other side of the said needle valve;

said hydraulic cylinder and said first and second conduits filled with hydraulic fluid so that movement of said piston in response to pivoting of said base plate causes said hydraulic fluid to flow from one side of said hydraulic cylinder, through said first and second conduits and said needle valve to the other side of said hydraulic cylinder thereby impeding rapid movement of said base plate in response to transient forces.

6. An improvement, as claimed in claim 3, wherein said limit means comprises:

an arm mounted on said base plate and extending outwardly therefrom;

a first flange stationarily mounted adjacent one side of said arm, said first flange having an opening therethrough;

a first bolt having a threaded end positioned through the opening in said first flange and directed toward said arm;

a second bolt having a threaded end positioned through the opening in said second flange and directed toward said arm;

first and second spring means respectively positioned about the threaded ends of said first and second bolts;

first and second nuts respectively threaded on the threaded ends of said first and second bolts thereby respectively retaining said first and second biasing means between said first and second nuts and said first and second flanges.

7. An improvement, as claimed in claim 6, wherein said torque sensing means comprises a switch positioned adjacent a head end of said first bolt, said switch operably connected to said motor so that when the torque on said output shaft is of sufficient magnitude to cause said arm to move said first bolt against the biasing of said first spring means, said first bolt engages said switch causing said switch to cause said motor to stop operating.

* * * * *